US005354529A

United States Patent [19]

Berger et al.

[11] Patent Number: 5,354,529

[45] Date of Patent: Oct. 11, 1994

[54] MELT SPINNING APPARATUS AND METHOD

[75] Inventors: Hans-Peter Berger, Remscheid; Ralph Sievering, Wermelskirchen, both of Fed. Rep. of Germany

[73] Assignee: Barmag AG, Fed. Rep. of Germany

[21] Appl. No.: 617,143

[22] Filed: Nov. 23, 1990

[30] Foreign Application Priority Data

Nov. 27, 1989 [DE] Fed. Rep. of Germany ..... 3939138

[51] Int. Cl.[5] ..... D01D 5/092

[52] U.S. Cl. ..... 264/176.1; 425/192 S; 425/378.2; 425/382.2; 425/461

[58] Field of Search ..... 264/176.1, 555, 556, 264/210.8, 211.14, 211.22; 425/72.1, 72.2, 378.2, 382.2, 192 S, 461, 462

[56] References Cited

U.S. PATENT DOCUMENTS

| | | | |
|---|---|---|---|
| 2,841,821 | 7/1958 | Phipps | 425/192 S |
| 3,498,230 | 3/1970 | Schippers | 418/200 |
| 3,724,492 | 4/1973 | Itter | 137/597 |
| 3,824,050 | 7/1974 | Balk | 425/72.2 |
| 3,881,850 | 5/1975 | Stockbridge . | |
| 3,938,925 | 2/1976 | Lees | 425/382.2 |
| 4,645,444 | 2/1987 | Lenk et al. | 425/192 S |
| 4,648,826 | 3/1987 | Ogasawara et al. | 425/192 S |
| 4,698,008 | 10/1987 | Lenk et al. | 425/192 S |
| 4,801,257 | 1/1989 | Lenk . | |
| 5,059,104 | 10/1991 | Alberto | 425/72.2 |

FOREIGN PATENT DOCUMENTS

| | | |
|---|---|---|
| 0122464 | 11/1988 | European Pat. Off. . |
| 0363317 | 9/1989 | European Pat. Off. . |
| 2022224 | 11/1971 | Fed. Rep. of Germany . |
| 2113327 | 10/1972 | Fed. Rep. of Germany . |
| 3818017 | 12/1988 | Fed. Rep. of Germany . |

*Primary Examiner*—Jill L. Heitbrink

*Attorney, Agent, or Firm*—Bell, Seltzer, Park & Gibson

[57] ABSTRACT

A melt spinning apparatus adapted for spinning a plurality of preferably monofilaments each having a denier which is maintained within close tolerances. The apparatus comprises a nozzle head having a plurality of vertical bores which are annularly arranged about a central axis and a nozzle assembly in each of the bores. A separate melt delivery system delivers pressurized melt to each nozzle assembly, and in a preferred embodiment, each separate melt delivery system comprises one of the discharge outlets of a planetary gear pump.

17 Claims, 3 Drawing Sheets

MELT SPINNING APPARATUS AND METHOD

BACKGROUND OF THE INVENTION

The present invention relates to a melt spinning apparatus for spinning a plurality of synthetic filaments, and of the general type disclosed in U.S. Pat. Nos. 4,698,008 and 4,645,444.

U.S. Pat. No. 4,645,444 discloses a melt spinning apparatus wherein a plurality of nozzle openings are supplied by a single pump. This is acceptable for all cases of application, wherein a single yarn is formed from all of the spun filaments. When in such a case a nozzle opening is fully or partially clogged, the melt flow will distribute over the remaining nozzle openings. However, the denier of the individual filaments will change only slightly corresponding to the large number of filaments, and the total denier of the yarn will be maintained.

In machines where the filaments are to be divided and combined to form several yarns, such clogging may result in yarns of a different denier from the one desired. Attempts have been made by the arrangement of annular lines and other hydraulic measures to avoid such defects, note for example, German Patent 20 22 224 and DE-OS 21 13 327.

It is an object of the present invention to spin a plurality of synthetic monofilaments (i.e. monofilament yarns) or yarns made of a few such monofilaments, in which the denier of the individual filaments and the denier of the yarn remain substantially constant regardless of whether or not any of the several nozzle openings is congested.

SUMMARY OF THE INVENTION

The above and other objects and advantages of the present invention are achieved in the embodiment illustrated herein by the provision of a melt spinning apparatus which comprises a heater jacket having a cylindrical inside jacket defining a cylindrical nozzle shaft which is open at its bottom, and block means having a plurality of melt delivery lines therein and positioned to close the upper portion of the nozzle shaft. A cylindrical nozzle head is closely received in the lower portion of the nozzle shaft and is attached to the bottom of the block means. The nozzle head has a plurality of vertical bores therein which are positioned in a generally circular arrangement about the central axis of the nozzle shaft, and a nozzle assembly is positioned in each of the bores. Each nozzle assembly comprises a melt delivery duct communicating with one of the delivery ducts in the block means, and a spinning nozzle is positioned in the lower portion of the bore, and with the spinning nozzle having one or more openings extending vertically therethrough. A separate melt delivery means is provided for delivering pressurized melt at a predetermined flow rate to each of the melt delivery ducts of the nozzle assemblies, and such that the pressurized melt is delivered to each nozzle assembly and extruded downwardly through the spinning nozzle of each nozzle assembly.

The present invention is based upon the knowledge that hydraulic measures for a uniform distribution of the melt flows to the individual nozzle openings are ultimately not successful. As a result of connecting each nozzle opening or group of nozzle openings to a separate pump, a self-regulating effect occurs, in which the clogging of a nozzle is made up for by a corresponding increase of pressure with the result that the melt throughput remains substantially constant.

The accommodation of a plurality of nozzle assemblies in the heater box of a conventional spinning apparatus is confronted with difficulties in the construction, assembly and service. These difficulties are eliminated in accordance with the preferred embodiment of the invention by the placement of a plurality of vertical bores which contain the nozzle assemblies, in a circular arrangement in a single nozzle head. Also, the nozzle head is mounted within a tubular nozzle shaft, and the nozzle head is directly attached to a distributor block, or a pump block, which is positioned in the nozzle shaft above the nozzle head.

By positioning the nozzle assemblies in a circle, the spinning of a plurality of yarns in a small gauge is possible.

In the preferred embodiment, the apparatus further includes a planetary gear pump having a plurality of discharge outlets, with each of the outlets comprising one of the separate melt delivery means and which supplies one of the nozzle assemblies. This structural configuration is favorable from the viewpoint of mechanical engineering, space, and in particular heat engineering, inasmuch as it allows a very compact construction of the pump and the pump block.

Both the nozzle head and the surrounding nozzle shaft are preferably cylindrical in configuration and have a circular cross section, which is very favorable with regard to their manufacture, since the nozzle head can be made on a rotary lathe. Moreover, it is especially advantageous also in terms of thermoengineering, since it ensures uniform heat distribution throughout the individual nozzle assemblies.

The nozzle head is preferably attached to the distributor block or the pump block by means of a threaded bolt which extends along the central axis of the nozzle shaft, and which is centrally located with respect to the circularly arranged nozzle assemblies. This facilitates the assembly and disassembly of the apparatus, and thereby facilitates maintenance. Of particular advantage is the fact that the nozzle head can be installed, removed and serviced from below.

Each nozzle assembly is preferably provided with a piston mounted for limited axial movement in the upper portion of the bore, and so as to define a cavity between the spinning nozzle and the piston. This construction renders it possible to connect only the nozzle head with the distributor block or the pump block for the purpose of supplying the pressurized melt, and to apply the sealing forces only after the startup. This construction has been found to be of considerable advantage, especially when the spinning apparatus is intermittently operated only, or repeatedly shut down and restarted without requiring additional readjustments in the sealing arrangement.

BRIEF DESCRIPTION OF THE DRAWINGS

Some of the objects and advantages of the present invention having been stated, other will appear when taken in conjunction with the accompanying drawings, in which.

DETAILED DESCRIPTION OF THE PREFERRED EMBODIMENT

Figure 1:
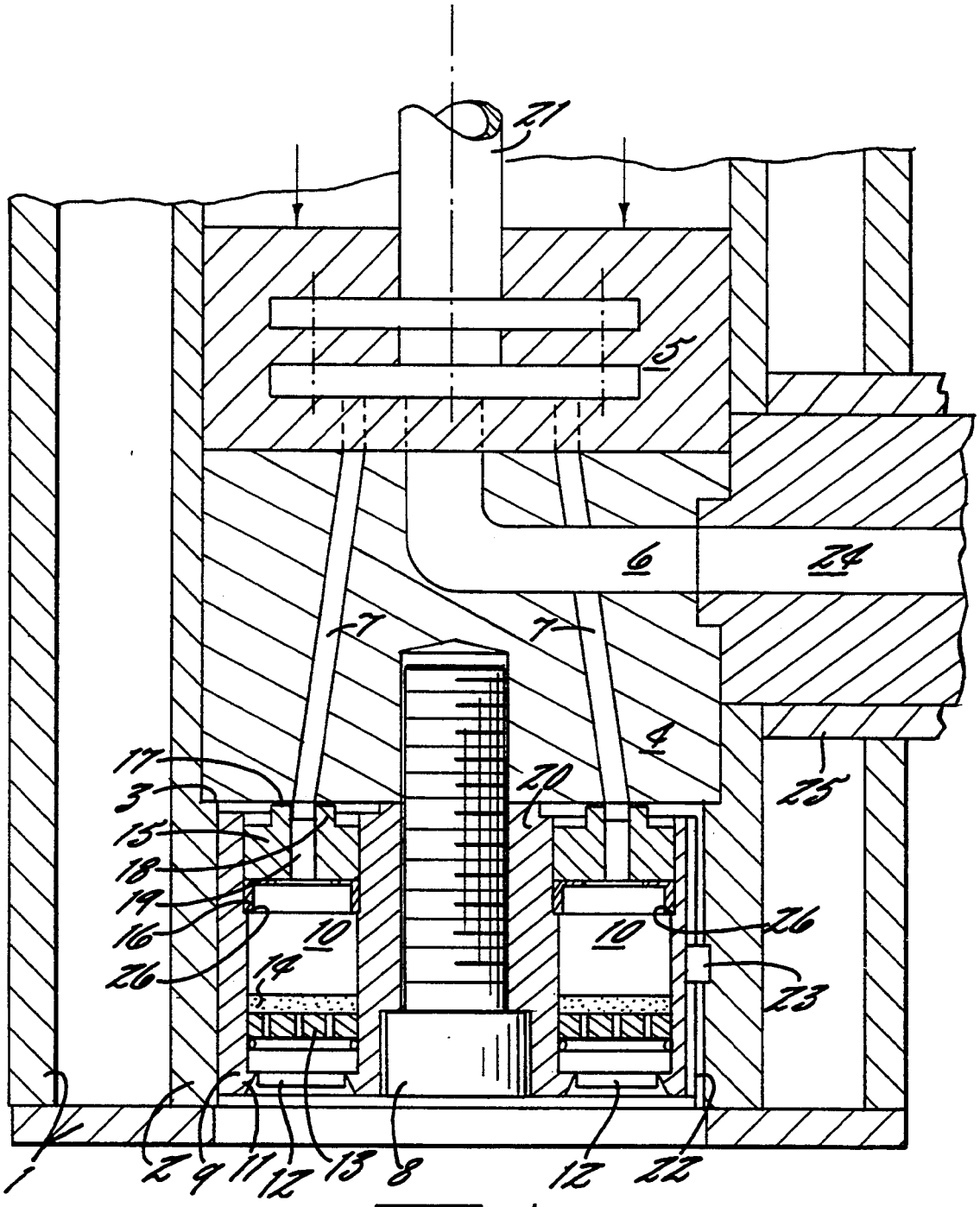
FIG. 1 is a sectional side elevation view of a melt spinning apparatus which embodies the features of the present invention.

Referring more specifically to the drawings, FIG. 1 illustrates a melt spinning apparatus which is accommodated in a heater box 1. The heater box 1 is a cylindrical body with an inside jacket and an outside jacket. The two jackets form between them a hermetically sealed hollow space, which is filled with a heating medium such as a heating fluid. The cylindrical inside jacket 2 of the heater box also defines a cylindrical nozzle shaft, which is vertically oriented to define a vertical central axis.

Figure 3:
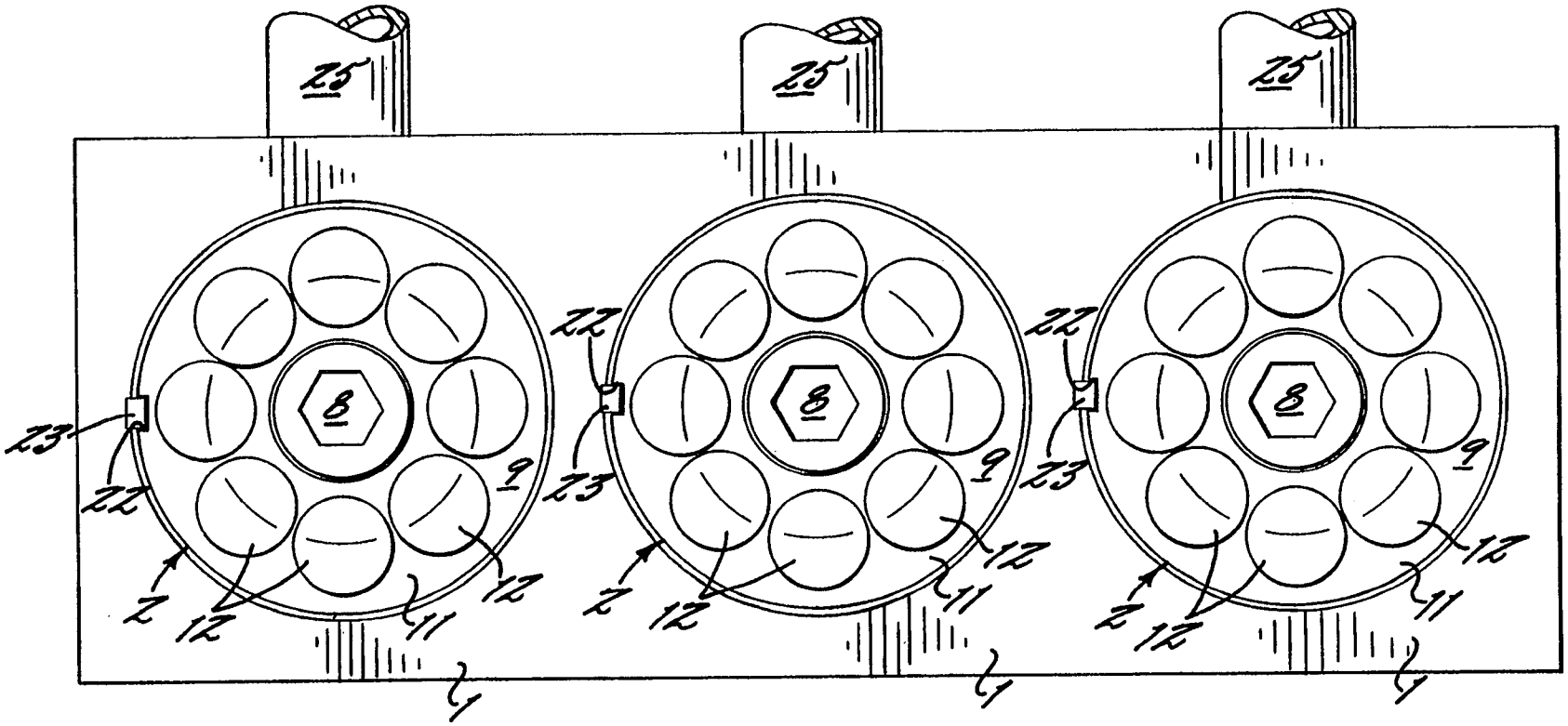
FIG. 3 is a view similar to FIG. 2, but illustrating an embodiment which includes several nozzle heads.

It should be noted that the following description will also apply to the spinning apparatus shown in FIG. 3 to the extent that the structures are alike.

The cylindrical nozzle shaft 2 is provided with a shoulder 3 adjacent its lower end, on which a distributor block 4 rests. The distributor block 4 fills the cross section of the nozzle shaft almost completely in the upper portion thereof. As a result, there is good heat conduct between the walls of the nozzle shaft 2 and the distributor block 4. Located above the distributor block 4 is the pump block S. The latter contains several gear pumps, which are here only schematically indicated. According to the present invention, it is preferred to use planetary gear pumps, each comprising a central gear and several planetary gears distributed over its circumference and engaging with the central gear. A planetary gear pump useful with the present invention, is disclosed in U.S. Pat. No. 3,498,230 to Schippers, the disclosure of which is expressly incorporated herein by reference. The pump is supplied via a melt supply line 6 and discharges into pump or melt delivery lines 7. The melt supply line 6 and the melt delivery lines 7 are arranged in the distributor block 4. The central gears of the two pumps are synchronously driven by a single pump shaft 21.

The melt line 6 is arranged in the distributor block 4, and it connects the pump with an extruder line 24. The extruder line 24 receives a molten, spinable polymer, for example polyethyleneterephalate, from a spinning extruder (not shown). The extruder line is surrounded by an insulating jacket and extends through the hollow space between the nozzle shaft 2 and the outer jacket of the heater box 1 by means of a cylindrical tube 25 welded thereto in a manner resistant to compression.

The melt delivery lines 7 are formed in the distributor block 4. Each of these lines 7 connects a pump outlet with a nozzle assembly 10. It should be emphasized that a planetary gear pump forms with each of its planetary gears a separate melt delivery means, whose pressure buildup and flow rate are independent of the pressure buildup and flow rate of the other melt delivery means. Thus, a planetary gear pump comprising a central gear and four planetary gears represents four separate melt delivery means in the meaning of the present application. Technically viewed, the two planetary gear pumps, as illustrate, thus form eight melt delivery means. Each of these eight melt delivery means is connected respectively via a melt delivery line 7 with a nozzle assembly 10.

Figure 2:
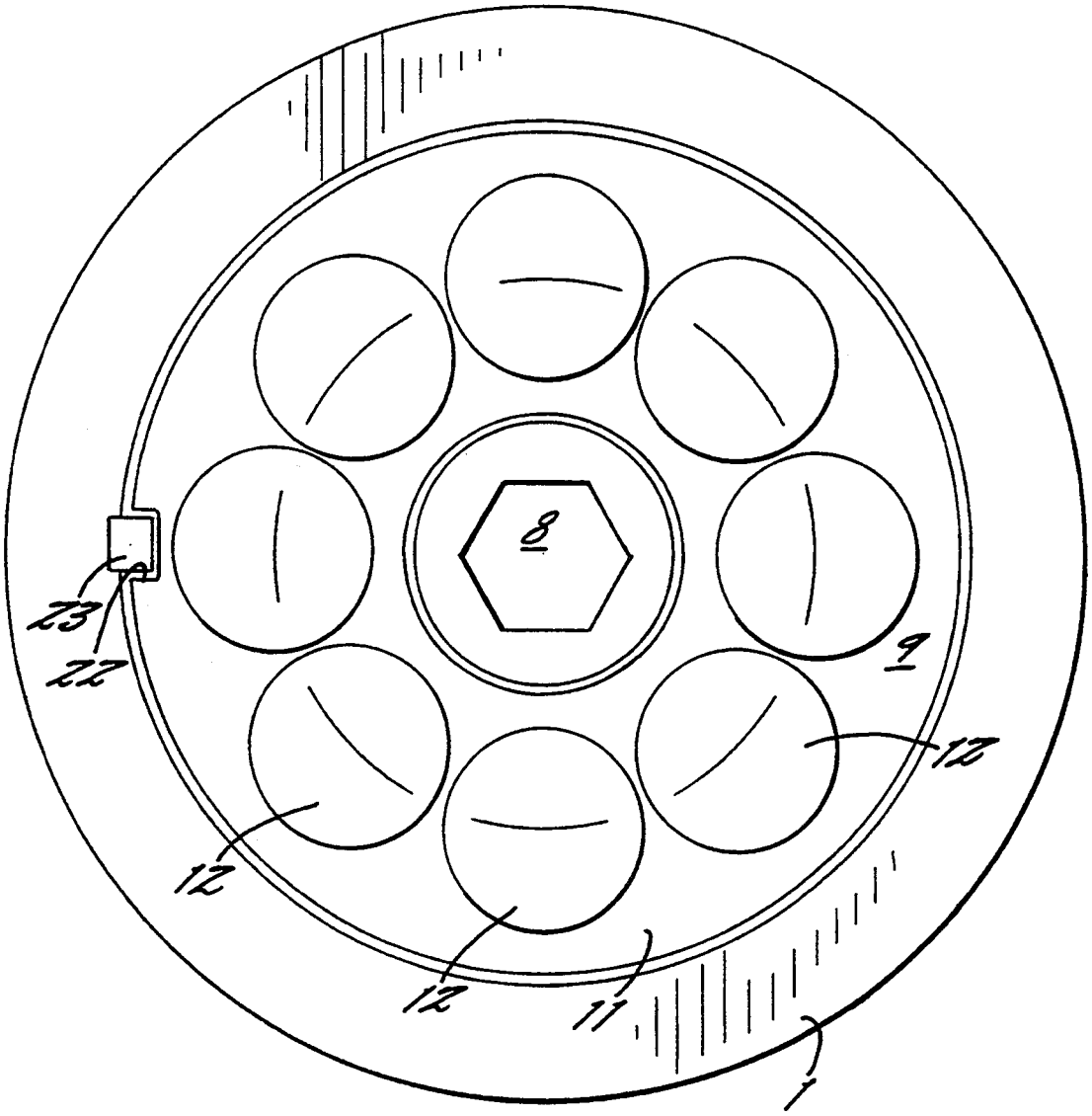
FIG. 2 is a bottom plan view of the apparatus shown in FIG. 1.

As shown in FIG. 2, the spinning apparatus comprises eight nozzle assemblies 10. The nozzle assemblies 10 are identical in their construction. A nozzle head 9 serves to accommodate the nozzle assemblies, and the head 9 is in the form of a cylindrical body, whose outer circumference is closely received into the lower portion of the nozzle shaft 2. The nozzle head is attached to the distributor block 4 by means of a central bolt 8. To this end, the head 9 is provided on its side facing the distributor block 4 with a ring 20, which allows the nozzle head to be firmly bolted to the distributor block 4 by means of the bolt 8. The nozzle head 9 also includes an axial grove 22 along its periphery, which engages with a wedge 23. The wedge 23 is attached to the inner wall of the nozzle shaft 2. The groove and wedge allow a straight guidance of the nozzle head in the axial direction.

On a circle concentric with the central axis, the nozzle head includes eight circular-cylindrical bores, which receive each the nozzle assemblies 10, and which include a spinning nozzle 12, a filter plate 13, a filter 14, a sealing ring 16 and a sealing piston 15.

In its upper portion, each nozzle assembly 10 has a larger diameter, which forms a shoulder 26 relative to the lower portion.

The spinning nozzle 12 may preferably be a monofilament nozzle, through which only one filament is spun. However, it is also possible to spin several filaments. Yet, it is preferred to apply the present invention to the spinning of monofilaments.

The spinning nozzle 12 rests on a circular shoulder 11, which defines the lower end of each nozzle assembly 10 and allows only the passage of the nozzle 12. The filter plate 13 serves to support the filter 14. These elements have the smaller diameter of the bore, while both the sealing ring 16 and sealing piston 15 have the larger diameter. The sealing piston 15 is slidable guided in the bore with limited play. In its center, it is provided with a melt delivery duct 19. Located on its front side facing the distributor block 4 is a centric, annular extension 18 with a connection seal 17. The connection seal 17 consists, for example, of a soft metal, which comes to lie sealable against the distributor block 4 by the forces being operative on the sealing piston 15. It should be emphasized that the melt delivery duct 19 is aligned respectively with one of the melt delivery lines 7.

Thus, the melt delivery line 7 and the delivery duct 19 supply the respective nozzle assembly 10 with melt under pressure. As a result, a pressure builds up in the cavity formed between the piston 15 and the spinning nozzle 12. The gap between the wall of the bore and the sealing piston 15 is sealed by the sealing ring 16, which pushes itself into the gap as a result of the pressure buildup. In its cross section, the sealing ring 16 is an angular ring, which covers the gap, but simultaneously leaves the delivery duct 19 uncovered. Stated otherwise, the arrangement is a self-sealing system, as is also described in a similar manner in the above mentioned U.S. Pat. No. 4,645,444.

As noted above, both the sealing ring 16 and the sealing piston 15 have an enlarged diameter and therefor rest on the shoulder 26. The axial extension of this enlarged diameter is so large that in the assembled state the connection seal 17 contacts the distributor block 4 substantially free of play.

To fabricate the spinning apparatus, the distributor block 4 and the pump block 5 are first inserted into the nozzle shaft 2. Then, the distributor block 4 is connected with the extruder line 24. Likewise, the pump block 5 is secured from the top to the distributor block in a manner not shown and anchored in the nozzle shaft.

FIG. 1 indicates by the arrows, that the pump block 5 is pushed by insertion forces from the top against the distributor block 4, and the distributor block 4 against the shoulder 3.

Next, the spinning head 9 is assembled. This means that the spinning nozzle 12, the filter plate 13, the filter 14, the sealing ring 16 and the sealing piston 15 with connection seal 17 are successively inserted into the bore of each nozzle assembly 10 from the top. Thereafter the nozzle head 9 is mounted to the bottom of the distribution block 4. To this end, the nozzle head is inserted into the open end of the spinning shaft and mounted by means of bolt 8 to the distribution block 4. Since each of the pistons is mounted to its respective bore in such a way that its connecting seal contacts the distributor block substantially free of play, when the nozzle head 9 is mounted to the distributor block, the installation may now be pressurized.

When the installation is pressurized, the pressure buildup in each of the nozzle assemblies 10 causes the sealing ring 16 to push into the gap between the outer walls of the bore and the sealing piston 15 and to seal the gap. In so doing, the sealing piston 15 is pushed upward, so that the connection seal 17 comes to lie against the distributor block 4 with a high surface pressure. Consequently, the connection seal effects the pressure-dependent sealing of the pressure line 7 and the sealing piston 15.

The heater box shown in FIG. 3 corresponds in its construction to the heater box disclosed in U.S. Pat. No. 4,698,008, i.e. the heater box is constructed as a beam. Its underside is provided with the nozzle shafts 2, and each of the nozzle shafts comprises a nozzle head 9 with eight nozzle pots. The construction of the nozzle heads 9 corresponds to the above description of FIGS. 1 and 2.

Whereas the spinning apparatus illustrated in FIGS. 1 and 2 is compact in its construction and therefore spatially favorable for the heat transfer, also with regard to the heater box, the spinning apparatus of FIG. 3 distinguishes itself in that several spinning head can be accommodated in a single heater box. Which of the embodiments is to be preferred depends on the spatial conditions. Because of its design favorable from a viewpoint of heating engineering, the embodiment of FIG. 1 is especially suitable for the production of monofilaments, which must exhibit a particularly high dimensional accuracy from filament to filament and over the length of the filament.

In the drawings and specification, there has been set forth a preferred embodiment of the invention, and although specific terms are employed, they are used in a generic and descriptive sense only and not for purposes of limitation.

That which is claimed is:

1. A method of simultaneously melt spinning a plurality of monofilaments, with each having a denier which is maintained within close tolerances, and comprising the steps of providing a nozzle head having a plurality of vertical bores therein, with a nozzle assembly positioned in each of said bores, and with each nozzle assembly comprising a melt delivery duct communicating with the upper portion of the bore and a spinning nozzle positioned at the lower portion of the bore and having one opening extending vertically therethrough, and delivering a pressurized melt to said delivery duct of each of said nozzle assemblies from a separate melt delivery means, and such that the pressurized melt is extruded downwardly through the spinning nozzle of each nozzle assembly to form a new filament therefrom, with all of said melt delivery means being synchronously driven by a single shaft, and with said separate melt delivery means being arranged circularly about said shaft so that substantially the same torque is delivered to all of said melt delivery means.

2. The method as defined in claim 1 wherein said separate melt delivery means each comprises one of the planetary gears of a planetary gear pump.

3. A melt spinning apparatus for spinning a plurality of synthetic filaments and comprising a heater box having a cylindrical inside jacket defining a cylindrical nozzle shaft which defines a central axis and which is open at its bottom, block means having ak plurality of melt delivery lines therein and positioned in said nozzle shaft so as to close the nozzle shaft at its upper portion, a nozzle head comprising a cylindrical body and being closely received in the lower portion of the nozzle shaft and being attached to the bottom of said block means, said nozzle head having a plurality of vertical bores therein positioned in a generally circular arrangement about said central axis of said nozzle shaft, a nozzle assembly positioned in each of said bores, with each nozzle assembly comprising a melt delivery duct communicating with one of the delivery liens in said block means, and a spinning nozzle positioned in the lower portion of the bore and having at least one opening extending vertically therethrough, and separate power-driven melt delivery means for delivering pressurized melt at a predetermined flow rate through each of said melt delivery lines and through each of said melt delivery ducts and such that the pressurized melt is delivered to each nozzle assembly and extruded downwardly through respective openings in each of said spinning nozzles of each nozzle assembly, and rotary means positioned coaxially relative to said central axis for commonly driving said separate melt delivery means, and with said separate melt delivery means being circularly arranged around said rotary means.

4. A melt spinning apparatus as defined in claim 3, wherein each of said spinning nozzles contains only one opening extending vertically therethrough for spinning a monofilament.

5. A melt spinning apparatus as defined in claim 3, wherein said rotary means and said separate melt delivery means comprises a multiple gear pump having a plurality of discharge outlets, with each of said discharge outlets comprising one of said separate melt delivery means.

6. A melt spinning apparatus defined in claim 5, wherein said multiple gear pump is a planetary gear pump.

7. A melt spinning apparatus as defined in claim 3, wherein said nozzle head is secured to the bottom of said block means by means of a threaded member which extends along said central axis.

8. A melt spinning apparatus as defined in claim 3, wherein said block means comprises a distribution block and a pump block positioned on one side of said distribution block, with said pump block mounting said separate melt delivery means.

9. A melt spinning apparatus as defined in claim 8, wherein said pump block is positioned in said nozzle shaft immediately above said distribution block.

10. The melt spinning apparatus ad defined in claim 9, wherein each nozzle assembly further comprises a piston mounted for limited axial movement in the upper portion of the associated bore so as to define a cavity between said spinning nozzle and said piston, and with said piston having an opening extending axially therethrough which communicates with said cavity and defines said melt delivery duct.

11. The melt spinning apparatus as defined in claim 10, wherein each nozzle assembly further comprises sealing ring means positioned in said cavity between said piston and said spinning nozzle for forming a seal between said piston and the walls of said bore, and so that said piston is biased upwardly against said distribution block upon pressurized melt being received in said cavity, and gasket means for forming a seal between said piston and said distribution block upon such upward biasing of said piston.

12. A melt spinning apparatus for spinning a plurality of synthetic filaments and comprising a heater box having a cylindrical inside jacket defining a cylindrical nozzle shaft which defines a central axis and which is open at its bottom, block means having ak plurality of melt delivery lines therein and positioned in said nozzle shaft so as to close the nozzle shaft at its upper portion, a nozzle head comprising a cylindrical body and being closely received in the lower portion of the nozzle shaft and being removably attached to the bottom of said block means by means of a threaded member which extends along said central axis, said nozzle head having a plurality of vertical bores therein positioned in a generally circular arrangement about said central axis of said nozzle shaft, a nozzle assembly positioned in each of said bores, with each nozzle assembly comprising a melt delivery duct communicating with one of the delivery liens in said block means, and a spinning nozzle positioned in the lower portion of the bore and having at least one opening extending vertically therethrough, and separate melt delivery means for delivering pressurized melt at a predetermined flow rate through each of said melt delivery lines and to each of said melt delivery ducts and such that the pressurized melt is delivered to each nozzle assembly and extruded downwardly through respective openings in each of said spinning nozzles of each nozzle assembly.

13. A melt spinning apparatus as defined in claim 12, wherein each of said spinning nozzles contains only one opening extending vertically therethrough for spinning a monofilament.

14. A melt spinning apparatus as defined in claim 12, wherein said separate melt delivery means is a planetary gear pump having a plurality of discharge outlets, with each of said discharge outlets comprising one of said separate melt delivery means.

15. A melt spinning apparatus as defined in claim 12, wherein said block means comprises a distribution block and a pump block positioned in said nozzle shaft immediately above said distribution block, with said pump block mounting said separate melt delivery means.

16. The melt spinning apparatus as defined in claim 15, wherein each nozzle assembly further comprises a piston mounted for limited axial movement in the upper portion of the associated bore so as to define a cavity between said spinning nozzle and said piston, and with said piston having an opening extending axially therethrough which communicates with said cavity and defines said melt delivery duct.

17. The melt spinning apparatus as defined in claim 16, wherein each nozzle assembly further comprises sealing ring means positioned in said cavity between said piston and said spinning nozzle for forming a seal between said piston and the walls of said bore, and so that said piston is biased upwardly against said distribution block upon pressurized melt being received in said cavity, and gasket means for forming a seal between said piston and said distribution block upon such upward biasing of said piston.

* * * * *